US006726547B2

(12) United States Patent
Narusaki et al.

(10) Patent No.: US 6,726,547 B2
(45) Date of Patent: Apr. 27, 2004

(54) CUTTING DEVICE FOR SHEET METAL DRUM

(75) Inventors: Yuji Narusaki, Sayama (JP); Yoshiharu Watabe, Sayama (JP); Takehisa Kimura, Sayama (JP); Tomotsugu Takahashi, Sayama (JP); Toru Nagakura, Sayama (JP); Yoriyuki Watanabe, Sayama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/363,536

(22) PCT Filed: Sep. 18, 2001

(86) PCT No.: PCT/JP01/08107

§ 371 (c)(1),
(2), (4) Date: May 2, 2003

(87) PCT Pub. No.: WO02/28580

PCT Pub. Date: Apr. 11, 2002

(65) Prior Publication Data

US 2003/0176154 A1 Sep. 18, 2003

(30) Foreign Application Priority Data

| | | |
|---|---|---|
| Oct. 5, 2000 | (JP) | 2000-306095 |
| Oct. 6, 2000 | (JP) | 2000-308243 |
| Oct. 23, 2000 | (JP) | 2000-323111 |
| Jan. 11, 2001 | (JP) | 2001-3978 |

(51) Int. Cl.[7] ..... B24B 7/00

(52) U.S. Cl. ..... 451/65; 451/385; 451/365; 451/443; 29/281.1

(58) Field of Search ..... 125/16.02, 21, 125/12, 13.01, 20; 451/54, 55, 56, 65, 69, 51, 385, 365, 443; 29/281.11, 283.5

(56) References Cited

U.S. PATENT DOCUMENTS

| | | | | |
|---|---|---|---|---|
| 4,227,348 A | * | 10/1980 | Demers | 451/41 |
| 5,845,630 A | * | 12/1998 | Yamada | 125/12 |
| 6,578,458 B1 | * | 6/2003 | Akram et al. | 83/13 |

FOREIGN PATENT DOCUMENTS

| | | |
|---|---|---|
| JP | 2 078 565 A | 1/1982 |
| JP | 1-87822 U | 6/1989 |

* cited by examiner

*Primary Examiner*—George Nguyen
(74) *Attorney, Agent, or Firm*—Birch, Stewart, Kolasch & Birch, LLP

(57) ABSTRACT

A drum slicing apparatus is capable of highly accurately and efficiently slicing a drum made of a thin metal sheet which is relatively highly flexible. The drum slicing apparatus has a support shaft rotatable about its own axis, a cylindrical drum holder supported on the support shaft for holding the drum by pressing engagement with an inner circumferential surface of the drum over an entire length thereof, and a slicing device having slicing edges for slicing the drum into the metal rings by engaging and cutting into the drum at predetermined cutting positions thereon while the drum is being rotated by the support shaft through the drum holder.

11 Claims, 8 Drawing Sheets

X
Z
Y
X
Z
X
X

X
Y
X
Z
Z
X

V
V
V
V
Z
Z
W1

CUTTING DEVICE FOR SHEET METAL DRUM

This application is the national phase under 35 U.S.C. § 371 of PCT International Application No. PCT/JP01/08107 which has an International filing date of Sep. 18, 2001, which designated the United States of America.

TECHNICAL FIELD

The present invention relates to an apparatus for slicing a cylindrical drum made of a thin metal sheet into a plurality of endless rings.

BACKGROUND ART

Belts for transmitting power in continuously variable transmissions, for example, use laminated rings of metal to bundle a plurality of elements that are arrayed in an annular endless pattern. Ring members of the laminated rings are produced by slicing, at certain axially spaced intervals, a cylindrical drum which is formed by welding opposite ends of a rectangular thin sheet of metal.

Heretofore, it has been known to slice a cylindrical drum at certain axially spaced intervals into ring members by clamping one end of the drum, pressing a rotating a grinding wheel or the like against an outer surface of the drum at the other end thereof, and moving the grinding wheel in a circumferential direction of the drum.

However, if the drum is sliced while it is being supported at one end thereof only, then since the drum is made of a thin metal sheet, the region of the drum pressed by the grinding wheel tends to be distorted, and the vibrations of the slicing apparatus are liable to be transmitted to the drum, vibrating the drum. As a result, the accuracy with which to slice the drum is lowered.

DISCLOSURE OF THE INVENTION

It is therefore an object of the present invention to provide a drum slicing apparatus which is capable of highly accurately and efficiently slicing a drum made of a thin metal sheet which is relatively highly flexible.

To achieve the above object, there is provided in accordance with the present invention an apparatus for slicing a cylindrical drum made of a thin metal sheet into a plurality of endless metal rings, comprising a support shaft rotatable about its own axis, a cylindrical drum holder supported on the support shaft for holding the drum by pressing engagement with an inner circumferential surface of the drum over an entire length thereof, and slicing means having slicing edges for slicing the drum into the metal rings by engaging and cutting into the drum at predetermined cutting positions thereon while the drum is being rotated by the support shaft through the drum holder.

The drum has recesses defined in opposite ends thereof, fully circumferential cut-off portions at the opposite ends including the recesses, and a ring forming region extending between the fully circumferential cut-off portions for forming the metal rings, the drum holder having engaging members for engaging in the recesses to prevent the fully circumferential cut-off portions from rotating when the drum holder holds the drum.

With the above arrangement, the drum is held by the drum holder, and rotated by the drum holder when the support shaft is rotated. The slicing edges of the slicing means are brought into abutment against the outer circumferential surface of the rotating drum at the predetermined cutting positions thereon, and cut into the drum in its circumferential direction, thus slicing the drum into the metal rings.

Since the drum is held with its inner circumferential surface pressed by the drum holder over the entire length of the drum, the drum, though it is made of a thin metal sheet, can be sliced by the slicing edges without being strained or vibrated. The drum can thus be sliced with high accuracy to produce highly accurate metal rings.

The drum is held by the drum holder with the engaging members engaging in the recesses. When the fully circumferential cut-off portions of the drum are cut off by the slicing edges, the fully circumferential cut-off portions are engaged by the engaging members against rotation. Therefore, even if the fully circumferential cut-off portions are of a relatively small width and are not sufficiently held in frictional engagement with the drum holder, the fully circumferential cut-off portions which have been cut off are reliably prevented from slipping on the drum holder and rotating in undulating motions, and hence from hitting and damaging the slicing edges.

The drum holder is removable from an end of the support shaft. Therefore, the drum can be mounted on and removed from the drum holder which has been removed from the support shaft. The drum can thus be mounted on and removed from the drum holder highly efficiently.

The support shaft comprises a main shaft rotatable about its own axis, a cylindrical collet disposed over the main shaft and radially spreadable by a plurality of axial slots defined in the cylindrical collet, and spreading means for radially spreading the cylindrical collet by widening the axial slots, the cylindrical drum holder having a plurality of axial slots defined therein which allow the cylindrical drum holder to spread radially, the arrangement being such that when the cylindrical drum holder is mounted on the cylindrical collet, the cylindrical drum holder is radially spreadable into pressing engagement with the inner circumferential surface of the drum in response to the cylindrical collet being spread by the spreading means.

The collet is radially spread by the spreading means, and the drum holder is radially spread as the collet is radially spread. That is, when the spreading means radially spreads the collet, the collet radially spreads the drum holder. When the drum holder is radially spread, the outer circumferential surface of the drum holder is pressed against the inner circumferential surface of the drum. The drum holder is thus pressed against the inner circumferential surface of the drum substantially uniformly over the entire length of the drum, for thereby holding the drum reliably highly accurately though the drum is relatively easily flexible. Since the drum holder can easily be removed from the collet when the collet is radially contracted, the drum holder can easily be removed from the support shaft.

The spreading means comprises a tapered surface disposed on the outer circumference of a proximal end of the main shaft at an end of the collet and progressively reduced in diameter toward a distal end of the main shaft, a tapered member movably mounted on the outer circumference of the distal end of the main shaft at an opposite end of the collet and axially movable on the main shaft, the tapered member being progressively reduced in diameter toward the proximal end of the main shaft, and a pressing member mounted on the distal end of the main shaft for engaging the tapered member, the arrangement being such that when the tapered member is pressed toward the tapered surface by the pressing member, the collet is radially spread by the tapered surface and the tapered member respective at the ends of the collet.

The tapered member is moved toward the tapered surface of the main shaft by the pressing member mounted on the distal end of the main shaft. As the tapered member is moved toward the tapered surface, the opposite ends of the collet slide against the tapered member and the tapered surface, radially spreading the collet uniformly over its entire length. When the collet is radially spread uniformly over its entire length, the drum holder mounted on the collet is also radially spread uniformly over its entire length, holding the drum highly accurately. When the pressing member is disabled to release the tapered member, the tapered member is moved away from the tapered surface of the main shaft, allowing the collet to be radially contracted uniformly over its entire length. The drum holder can therefore be removed from the collet smoothly and quickly.

The cylindrical drum is prepared by shaping a rectangular thin sheet of metal into a cylindrical form and butt-welding opposite ends of the rectangular thin sheet of metal, the recesses being used to position the opposite ends when the opposite ends are butt-welded. For forming the drum from the rectangular thin sheet of metal, the rectangular thin sheet of metal is curved into a cylindrical form, holding the opposite ends thereof against each other, and butt-welding the opposite ends. Since the opposite ends of the rectangular thin sheet of metal need to be welded highly accurately, the opposite ends that are held against each other are positioned using jigs engaging in the recesses. Since the opposite ends of the rectangular thin sheet of metal are thus positioned with the recesses for positioning these opposite ends, it is not necessary to form new recesses for positioning these opposite ends. Accordingly, a preparatory process for slicing the drum is simplified, and the efficiency of the slicing process is increased.

The slicing edges are spaced apart at intervals along an axial direction of the drum holder. The slicing edges cut into the drum at spaced intervals for simultaneously forming a plurality of metal rings of given width. Therefore, the metal rings can be produced from the drum highly efficiently.

The drum holder has a plurality of annular grooves defined in an outer circumferential surfaces in alignment with the respective predetermined cutting positions on the drum. When the slicing edges slice the drum, the slicing edges cutting into the drum and the drum holder are prevented from interfering with each other, and the drum can be sliced with increased accuracy.

The slicing means comprises a plurality of disk-shaped grinding wheels having abrasive grain slicing edges as the slicing edges on outer circumferential edges thereof for cutting into the predetermined cutting positions on the drum, further comprising dressing members disposed respectively in the annular grooves for dressing the abrasive grain slicing edges in sliding contact therewith when the abrasive grain slicing edges cut into the drum. When the abrasive grain slicing edges slice the drum supported on the drum holder, the abrasive grain slicing edges enter the annular grooves in the drum holder. Since the dressing members are disposed in the annular grooves, the abrasive grain slicing edges are held in sliding contact with the dressing members. Therefore, even when the abrasive grain slicing edges are loaded when they slice the drum, the abrasive grain slicing edges are immediately dressed by the dressing member. It is not necessary to remove the grinding wheels and dress the abrasive grain slicing edges when the abrasive grain slicing edges are loaded. The grinding wheels are thus efficiently dressed, and the abrasive grain slicing edges have their slicing capability maintained well without reducing the slicing efficiency.

The drum holder is radially contractible, further comprising ring removing means for radially contracting the drum holder which is removed from the support shaft while holding the metal rings sliced from the drum, thereby releasing the drum holder from pressing engagement with inner circumferential surfaces of the metal rings. The drum holder removed from the support shaft is radially contracted by the ring removing means and released from the inner circumferential surfaces of the metal rings, which are now released from being held by the drum holder. The metal rings which were held in intimate contact with the drum holder are prevented from suffering damage which would otherwise be caused by frictional contact between the circumferential wall of the drum holder and the inner circumferential surfaces of the metal rings when the metal rings are removed from the drum holder. The metal rings can thus be removed from the drum holder with ease. The metal rings can be removed in a highly accurate damage-free configuration.

Preferably, the drum holder has a pair of tapered surfaces disposed on respective upper and lower ends thereof and progressively reduced in diameter outwardly in an axial direction thereof, and the ring removing means comprises radially contracting means for holding the drum holder, with its axis directed vertically, removed from the support shaft, and radially contracting the drum holder, and a ring receiver disposed below the drum holder held by the radially contracting means, for receiving the metal rings released and dropped from the drum holder when the drum holder is radially contracted. The radially contracting means comprises a drum holder rest for placing the drum holder thereon in abutment against a lower end of the drum holder, a presser vertically movably disposed in confronting relation to the drum holder rest, for pressing an upper end of the drum holder downwardly, and lifting and lowering means for lifting and lowering the presser. The drum holder rest has a first slanted guide for slidingly engaging the tapered surface on the lower end of the drum holder to guide the drum holder in a direction to radially contract the drum holder, and the drum holder rest has a second slanted guide for slidingly engaging the tapered surface on the upper end of the drum holder to guide the drum holder in a direction to radially contract the drum holder.

With the drum holder and the ring removing means being thus constructed, the drum holder which is holding the metal rings sliced from the drum is placed, with its axis directed vertically, on the drum holder rest, and the presser presses the upper end of the drum holder. Then, the lifting and lowering means lowers the presser to cause the presser to press the drum holder axially. At this time, the tapered surface on the lower end of the drum holder is slidingly guided along the first slanted guide of the guide holder rest, and, at the same time, the tapered surface on the upper end of the drum holder is slidingly guided along the second slanted guide of the presser. The first and second slanted guides guide the drum holder in a direction to radially contract the drum through the tapered surfaces. The drum holder is thus radially contracted and released from the metal rings which have been supported on the outer circumferential surface of the drum holder, and the metal rings released from being supported by the drum holder drop onto the ring receiver by gravity.

When the drum holder is simply pressed and gripped between the drum holder rest and the presser, the metal rings can smoothly and quickly be removed from the drum holder without causing damage to the metal rings and the drum holder.

Since the drum can be sliced into highly accurate metal rings, the sliced metal rings may be used as ring members that are required to be highly accurate for bundling a plurality of elements arrayed in an endless pattern for use as a belt in a continuously variable transmission.

The above and other objects, features, and advantages of the present invention will become apparent from the following description when taken in conjunction with the accompanying drawings which illustrate a preferred embodiments of the present invention by way of example.

BEST MODE FOR CARRYING OUT THE INVENTION

Figure 1:
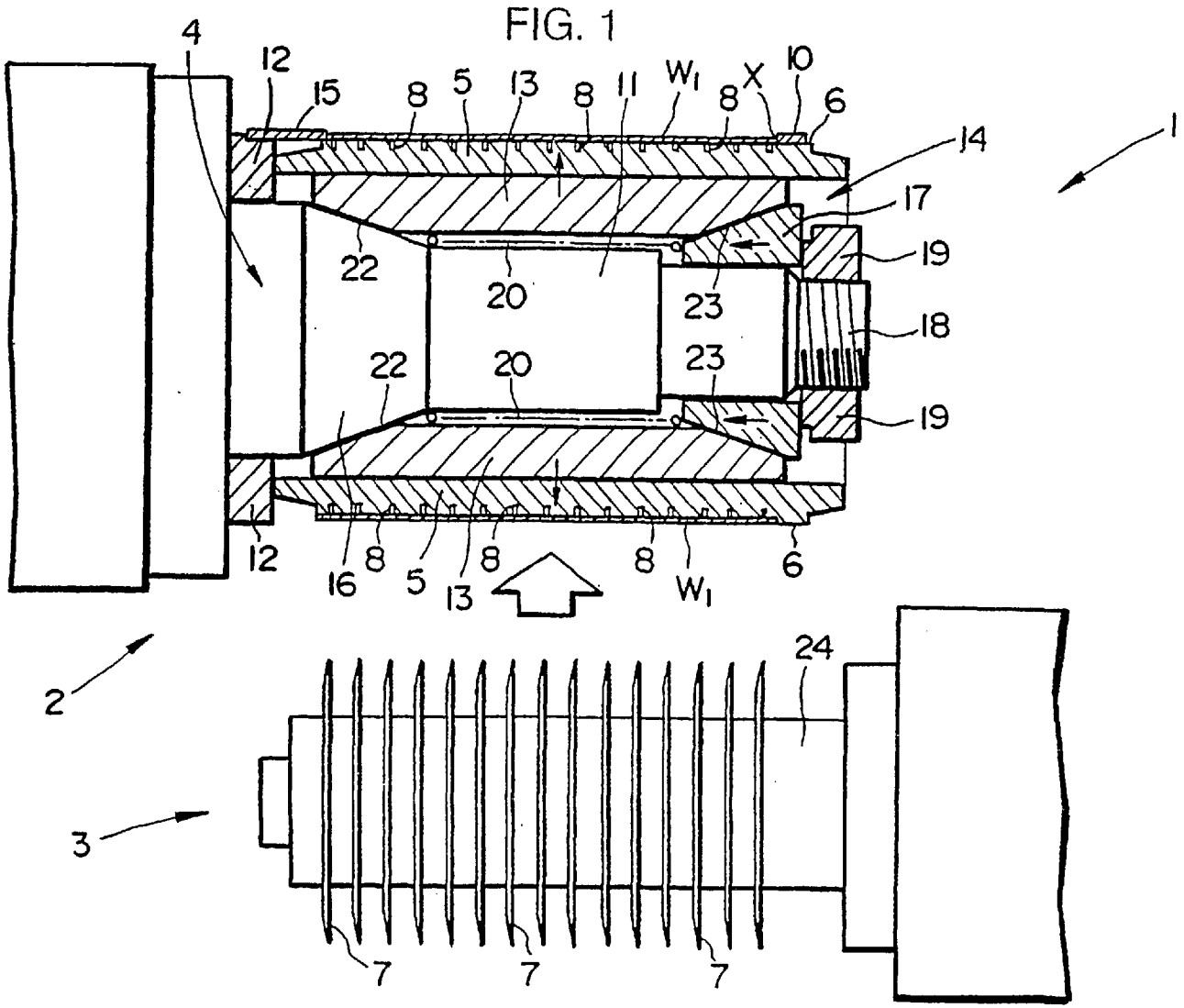
FIG. 1 is a view, partly in cross section, of a drum slicing apparatus according to the present invention, FIGS. 2(*a*) through 2(*c*) are perspective views illustrative of a process of forming a drum.
Figures 2A, 2B, 2C:
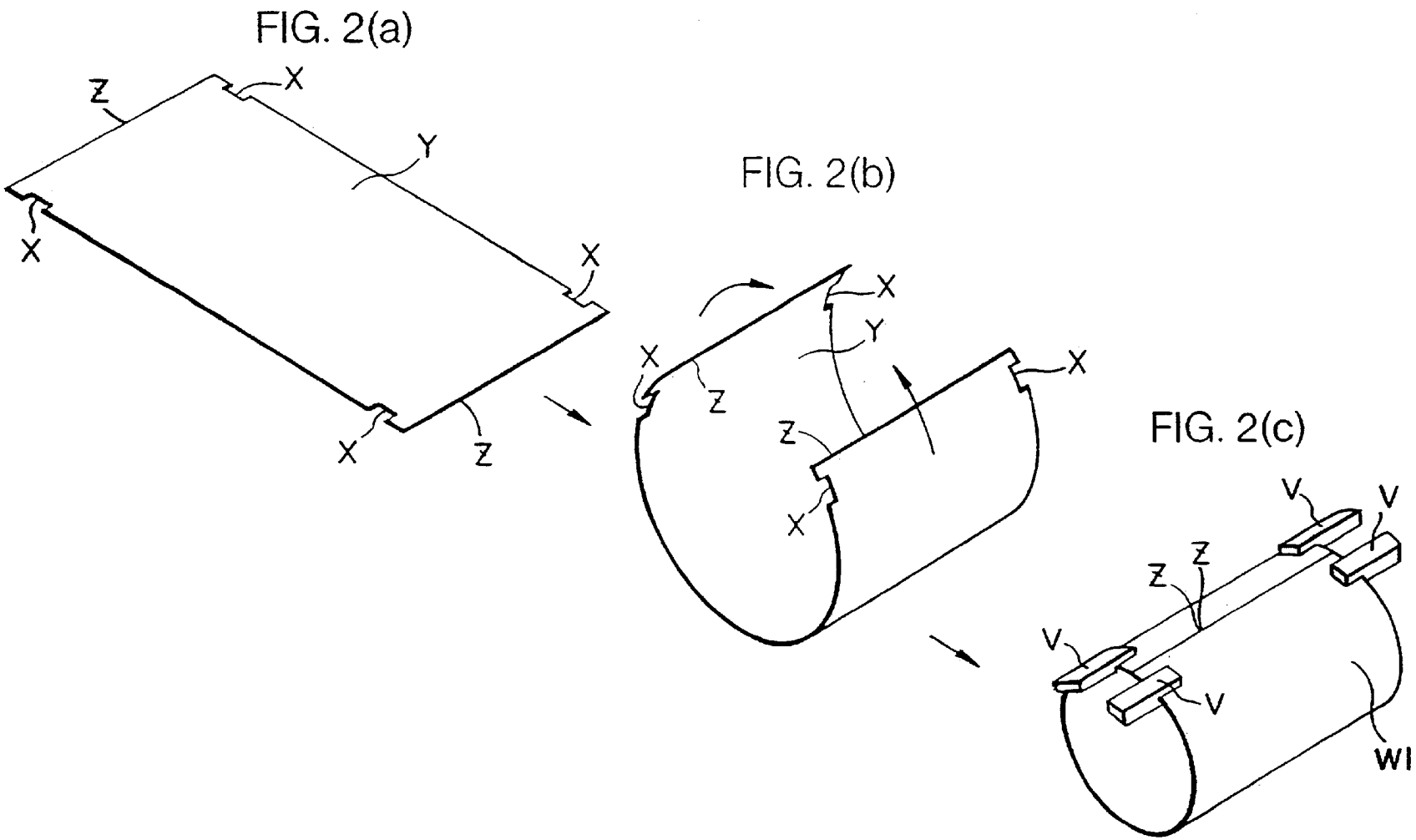

As shown in FIG. 1, a drum slicing apparatus 1 according to the present invention serves to slice a drum W1 of thin metal sheet at certain axial intervals into metal rings for use as ring members of a belt for a continuously variable transmission (not shown). The drum W1 is produced by shaping a rectangular flat sheet Y of maraging steel as shown in FIG. 2(*a*) into a cylindrical form as shown in FIGS. 2(*b*) and 2(*c*), and then butt-welding opposite ends Z of the sheet Y in the cylindrical form.

As shown in FIG. 1, the drum slicing apparatus 1 comprises a drum holding means 2 for holding the drum W1 and a slicing means 3 for slicing the drum W1.

The drum holding means 2 has a support shaft 4 rotatable about its own axis by a rotating means (not shown) and a drum holder 5 detachably mounted on the support shaft 4 for holding the drum W1 on its outer circumferential surface.

Figure 3:
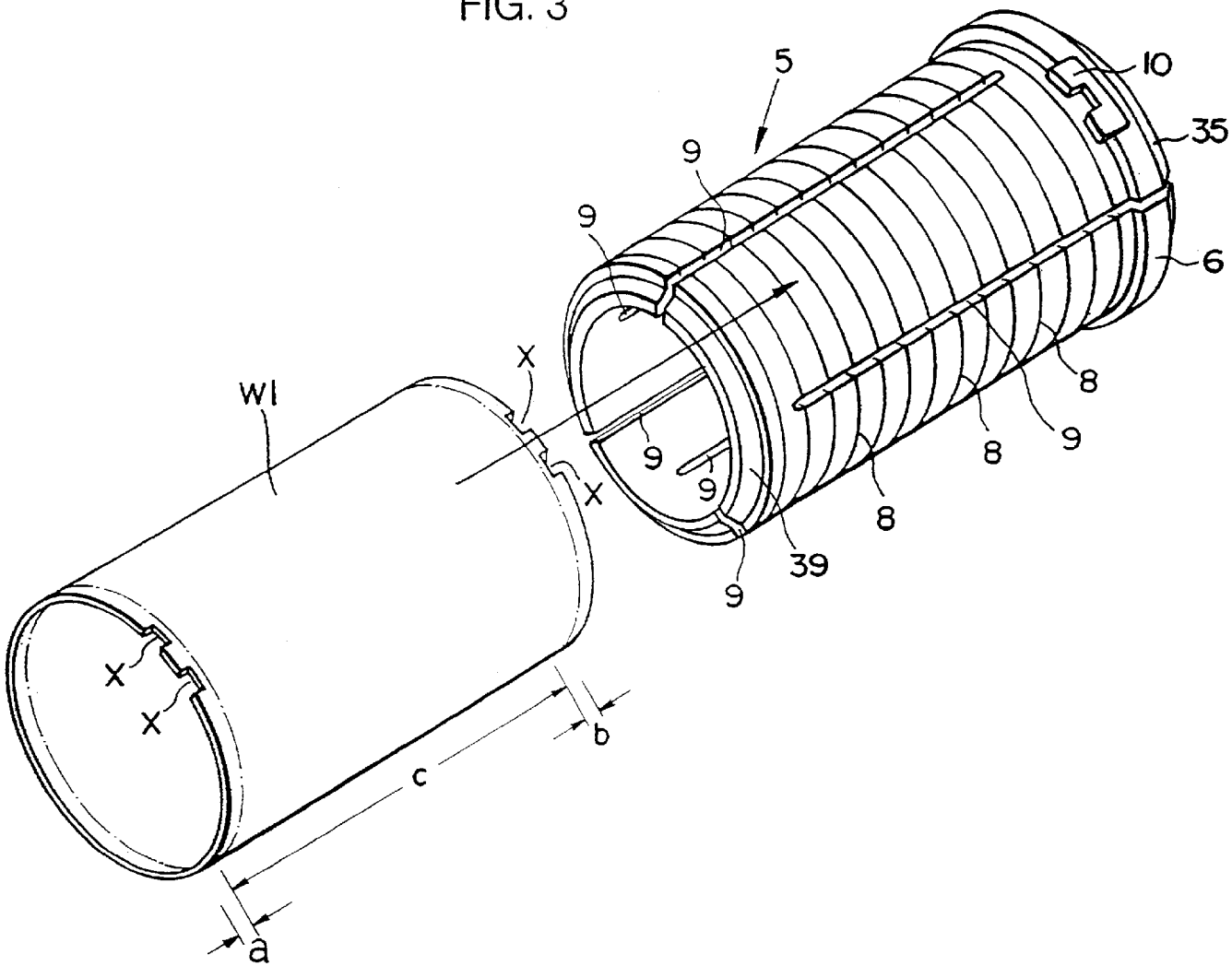
FIG. 3 is a perspective view of a drum and a drum holder.

As shown in FIGS. 1 and 3, the drum holder 5 is molded into a substantially cylindrical shape of synthetic resin, and has an annular land 6 on the outer circumferential surface of one end thereof for abutting against an end of the drum W1. The drum holder 5 has a plurality of annular grooves 8 defined in the outer circumferential surface thereof at axially spaced intervals and extending along cutting positions where the drum W1 are to be cut, i.e., piercing positions where grinding wheels 7 cut in. The drum holder 5 also has a plurality of axial slots 9 defined therein and extending in its axial or longitudinal direction. The axial slots 9 include slots 9 having open ends at one end of the drum holder 5 and slots 9 having open ends at the other end of the drum holder 5, these slots 9 alternating with each other in the circumferential direction of the drum holder 5. The axial slots 9 allow the drum holder 5 to spread radially outwardly as they become wider. A first engaging member 10 for engaging in recesses X defined in the end of the drum W1 is mounted on the annular land 6. As shown in FIG. 2(*a*), the recesses X are defined in the vicinity of the opposite ends Z respectively at the four corners of the sheet Y. As shown in FIG. 2(*c*), positioning jigs V engage in the respective recesses X to position the ends Z accurately in abutment against each other when the ends Z are butt-welded.

As shown in FIG. 1, the support shaft 4 comprises a main shaft 11 coupled to the non-illustrated rotating means and an abutment block 12 fixedly mounted on the proximal end of the main shaft 1. The support shaft 4 also has a radially spreadable collet 13 and a spreading means 14 for radially spreading the collet 13. The abutment block 12 serves to abut against the drum holder 5 and the other end of the drum W1 for thereby positioning the drum W1 fitted over the drum holder 5. A second engaging member 15 is mounted on the abutment block 12 for engaging in the recesses X in the other end of the drum W1.

The spreading means 14 comprises a tapered surface 16 integral with the outer circumference of the proximal end of the main shaft 11 and progressively reduced in diameter toward the distal end of the main shaft 11, and an annular tapered member 17 movably mounted on the outer circumference of the distal end of the main shaft 11 and axially movable on the main shaft 11, the annular tapered member 17 being progressively reduced in diameter toward the proximal end of the main shaft 11. The distal end of the main shaft 11 includes an externally threaded portion 18 with a presser nut (pressing member) 19 threaded thereover. When the presser nut 19 is turned along the externally threaded portion 18, it pushes the tapered member 17 axially toward the proximal end of the main shaft 11. The tapered member 17 is normally urged to move toward the distal end of the main shaft 11 by a spring 20 disposed around the main shaft 11.

Figure 4:
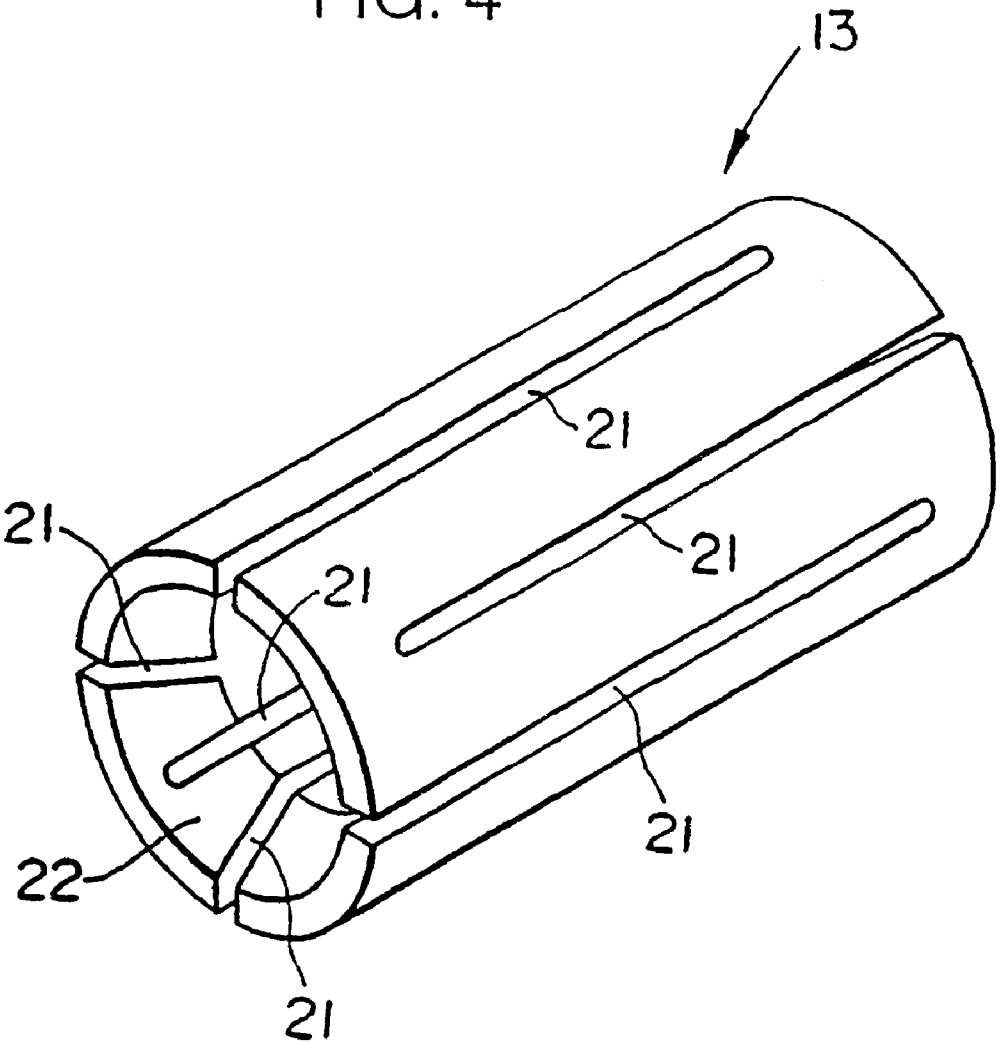
FIG. 4 is a perspective view of a collet.

As shown in FIGS. 1 and 4, the collet 13 is of a substantially cylindrical shape and has a plurality of axial slots 21 defined therein and extending in the axial or longitudinal direction thereof. The axial slots 21 include slots 21 having open ends at one end of the collet 13 and slots 21 having open ends at the other end of the collet 13, these slots 21 alternating with each other in the circumferential direction of the collet 13. The axial slots 21 allow the collet 13 to spread radially outwardly as they become wider. As shown in FIG. 1, the collet 13 has a first tapered sliding surface 22 on the inner circumference of one end thereof which is held in sliding contact with the tapered surface 16 and a second tapered sliding surface 23 on the inner circumference of the other end thereof which is held in sliding contact with the tapered member 17. When the tapered member 17 is moved toward the tapered surface 16 upon rotation of the presser nut 19 on the externally threaded portion 18, the first and second tapered sliding surfaces 22, 23 are pushed radially outwardly by the tapered surface 16 and the tapered member 17, respectively, in sliding engagement therewith, radially spreading the collet 13 to press and spread the drum holder 5 radially outwardly.

As shown in FIG. 1, the slicing means 3 has a rotatable shaft 24 and an array of disk-shaped grinding wheels (slicing edges) 7 supported on the rotatable shaft 24. The grinding wheels 7 are axially spaced at given intervals, and are radially held in alignment with the annular grooves 8 of the drum holder 5. The slicing means 3 also has a rotating means (not shown) coupled to the rotatable shaft 24 and a moving means (not shown) for moving the grinding wheels 7 toward and away from the drum W1 and pressing the grinding wheels 7 against the drum W1 to slice the drum W1.

Operation of the drum slicing apparatus 1 will be described below. In FIG. 1, the spreading means 14 is disabled to allow the collet 13 to be contracted radially, releasing the drum holder 5 from being pressed by the collet 13, and then the drum holder 5 is removed from the support shaft 4. Then, as shown in FIG. 3, the drum W1 is mounted on the drum holder 5. At this time, the recesses X in one end of the drum W1 are engaged by the first engaging member 10 on the annular land 6.

Then, as shown in FIG. 1, the drum holder 5 with the drum W1 mounted thereon is installed on the support shaft 4. At this time, the drum holder 5 and the drum W1 are brought into abutment against the abutment block 12, with the recesses X in the other end of the drum W1 being engaged by the second engaging member 15 on the abutment block 12.

The presser nut 19 of the spreading means 14 is then turned to move the tapered member 17 axially toward the tapered surface 16, thus radially spreading the collet 13 and hence the drum holder 5 thereby to holding the drum W1 in position on the drum holder 5.

Then, the rotatable shaft 4 is rotated about its own axis, rotating the drum holder 5 and the drum W1. The grinding wheels 7 of the slicing means 7 are rotated about their own axes, and also pressed against the drum W1. The grinding wheels 7 cut radially into the drum W1 to slice the drum W1 circumferentially into a plurality of metal rings.

The end portions of the drum W1 where the recesses X are defined are not used as ring members of a belt for a continuously variable transmission. Those end portions of the drum W1 are cut off by the grinding wheels 7 which are positioned at the opposite ends of the array of the grinding wheels 7, at the same time that the drum W1 is sliced by the grinding wheels 7. The cut-off end portions of the drum W1 have a width smaller than the width of the ring members in order to effectively utilize the material of the drum W1. Because of the smaller width of the cut-off end portions of the drum W1, those end portions of the drum W1 tend to be held insufficiently on the drum holder 5 and to slip on the drum holder 5 the instant they are cut off into rings. If the cut-off end portions are elongated or strained, then they are likely to rotate in undulating motions with the rotating grinding wheels 7, tending to cause damage to the grinding wheels 7. In the present embodiment, the end portions of the drum W1 to be cut off are locked in position by the first and second engaging members 10, 15 engaging in the recesses X in the drum W1. Therefore, the end portions of the drum W1 to be cut off are prevented from slipping on the drum holder 5, and hence from damaging the grinding wheels 7.

Figure 5:
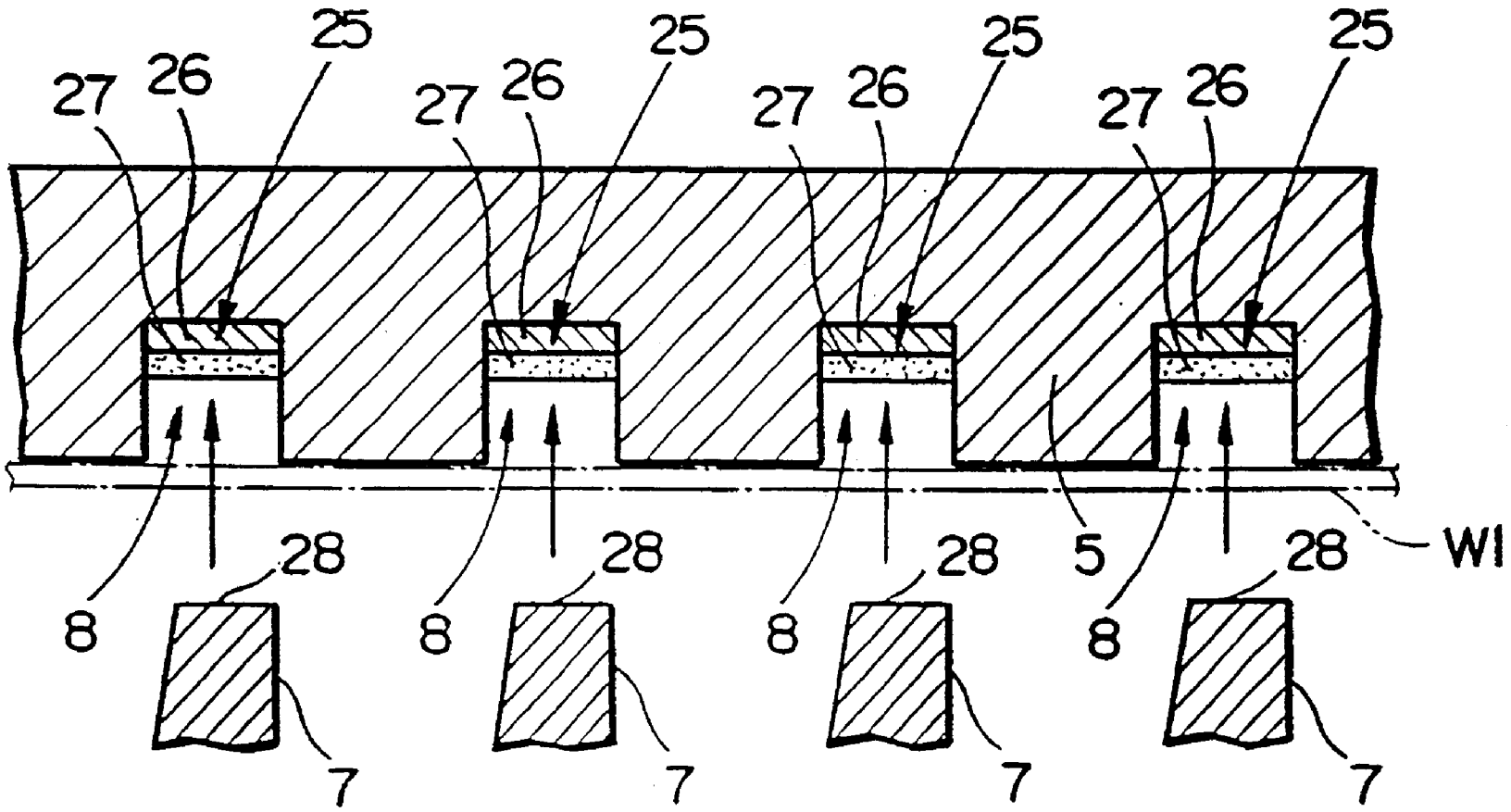
FIG. 5 is an enlarged fragmentary cross-sectional view of the drum holder, showing a dressing member.

As shown in FIG. 5, dressing members 25 are preferably disposed on the bottoms of the respective annular grooves 8. Each of the dressing members 25 comprises a metal base plate 26 and diamond particles 27 electro-deposited on the metal base plate 26. When the grinding wheels 7 slice the drum W1, the grinding wheels 7 enter the respective annular grooves 8 and have their abrasive grain slicing edges 28 on their outer circumferential edges held in sliding contact with the dressing members 25. Therefore, when the grinding wheels 7 slice the drum W1, their abrasive grain slicing edges 28 are simultaneously dressed by the dressing members 25. Therefore, the loading of the abrasive grain slicing edges 28 is removed at the same time that the grinding wheels 7 slice the drum W1. In addition, the grinding wheels 7 are uniformly ground to equal outside diameters by the dressing members 25. Accordingly, the abrasive grain slicing edges 28 can be dressed by the dressing members 25 in the annular grooves 8 without the need for removal of the grinding wheels 7 from the rotatable shaft 24. Since the abrasive grain slicing edges 28 are dressed by the dressing members 25 immediately after the drum W1 is sliced, the combined process of slicing the drum W1 and dressing the abrasive grain slicing edges 28 is performed highly efficiently. As the grinding wheels 7 are uniformly ground to equal outside diameters by the dressing members 25, the grinding wheels 7 are capable of reliably slicing the drum W1 without a slicing failure.

For slicing the drum W1 into a plurality of metal rings, a single grinding wheel may be used, instead of the plural grinding wheels 7 as shown, to slice the drum W1 successively from one end thereof to the other to produce one metal ring at a time. Even with the single grinding wheel used, the drum holder 5 with the annular grooves 8 and hence the dressing members 25 disposed therein may be used to dress the abrasive grain cutting edge of the single grinding wheel with one of the dressing members 9 each time the single grinding wheel produces a metal ring from the drum W1.

In the illustrated embodiment, the disk-shaped grinding wheels 7 are used as slicing edges of the slicing means 3. However, the slicing means 3 may comprise a plurality of single-point cutting tools (not shown) as slicing edges.

Metal rings W2 (see FIG. 7) thus sliced from the drum W1 are then removed from the drum holder 5. A process of removing the metal rings W2 from the drum holder 5 will be described below. In the present embodiment, the metal rings W2 are removed from the drum holder 5 by a ring remover 29 shown in FIG. 6. First, structural details of the ring remover 29 will be described below.

Figure 6:
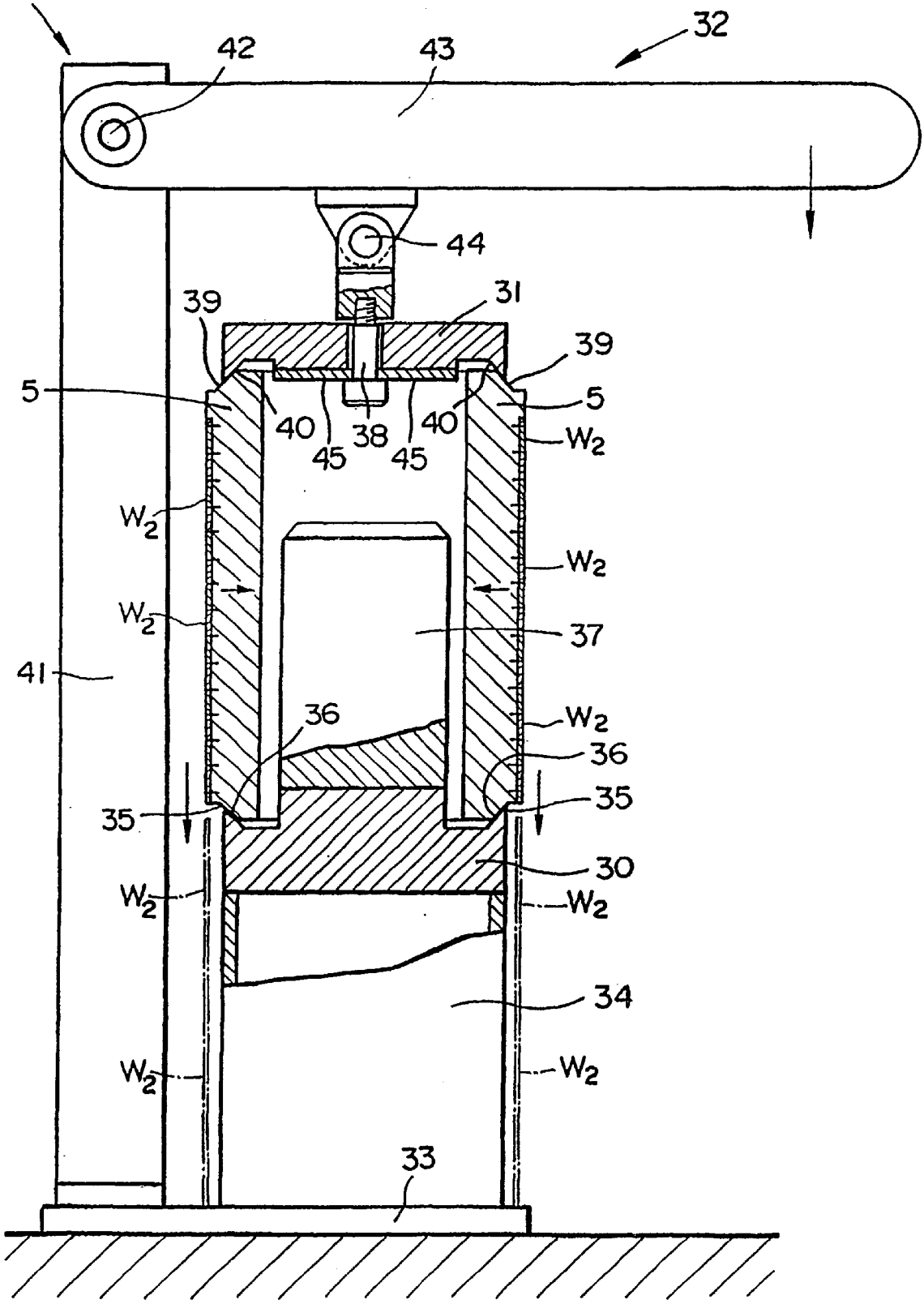
FIG. 6 is an elevational view, partly in cross section, a ring remover.

As shown in FIG. 6, the ring remover 29 comprises a drum holder rest 30 for placing the drum holder 5 thereon, a vertically movable presser 31 disposed above the drum holder rest 30, and a pressing means (lifting and lowering means) 32 for lifting and lowering the presser 31 and pressing the presser 31 against the drum holder 5 downwardly.

The drum holder rest 30 is fixedly mounted on a ring receiver 34 mounted on a base 33. The drum holder rest 30 has, on its upper surface, a slanted guide 36 for slidingly engaging a first tapered surface 35 on the lower end of the drum holder 5 to guide the drum holder 5 in a direction to radially contract the drum holder 5. The drum holder rest 30 also has a guide rod 37 projecting upwardly from the center thereof for guiding the drum holder 5 onto the drum holder rest 30.

The presser 31 is suspended from the pressing means 32 by a bolt 38. The presser 31 has, on its lower surface, a second slanted guide 40 for slidingly engaging a second tapered surface 39 on the upper end of the drum holder 5 to guide the drum holder 5 in a direction to radially contract the drum holder 5. The first slanted guide 36 of the drum holder rest 30 and the second slanted guide 40 of the presser 31 jointly make up a contracting means.

The pressing means 32 comprises a support column 41 vertically mounted on the base 33 and a swing lever 43 swingably mounted on the upper end of the support column 41 by a pivot shaft 42. The presser 31 is connected by the bolt 38 to a link 44 which is pivotally coup-led to the swing lever 43. The bolt 38 extends through the presser 31, connecting the presser 31 to the link 44 with a holder plate 45 interposed between the head of the bolt 38 and the presser 31.

Figure 7:
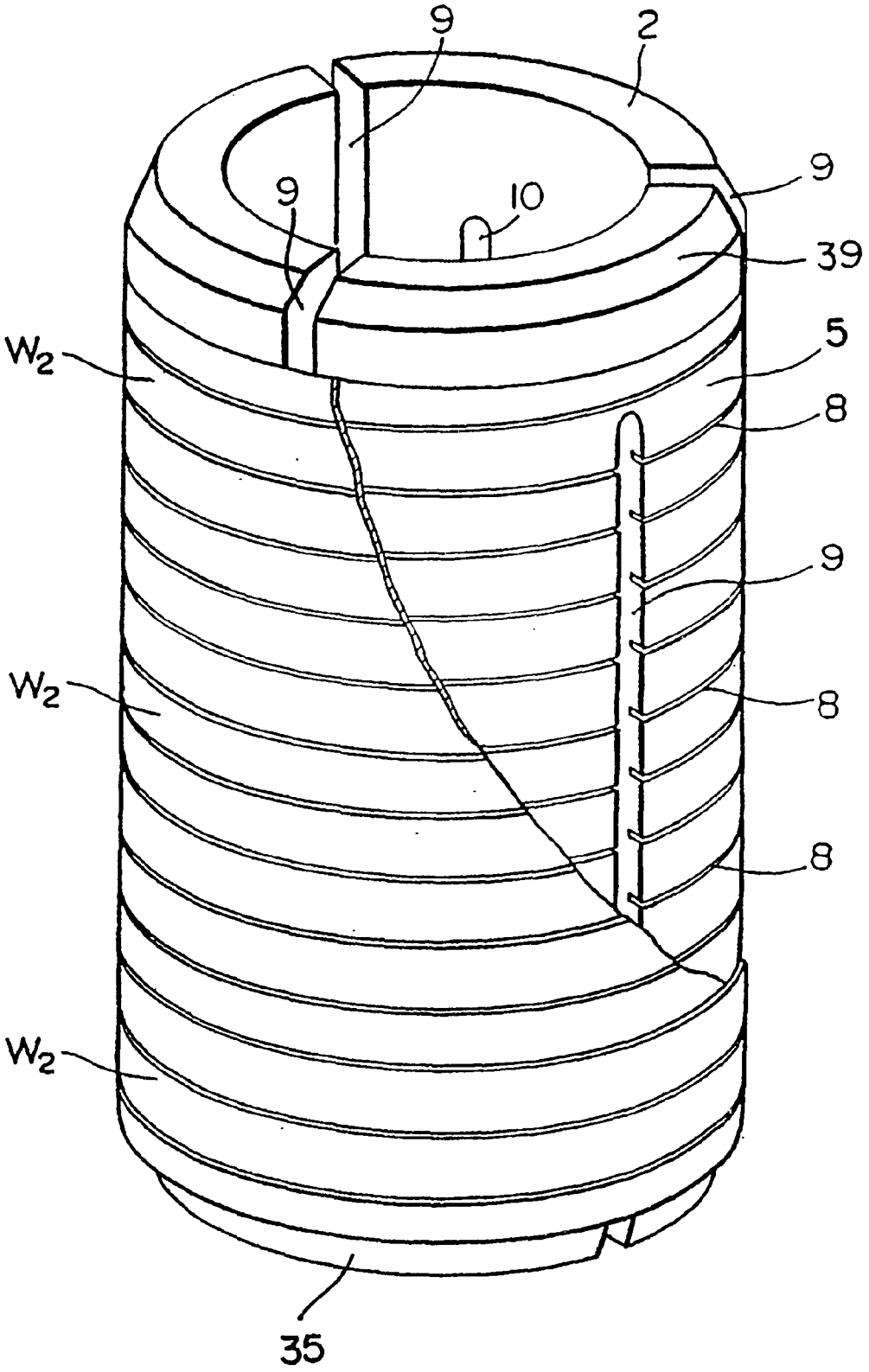
FIG. 7 is a perspective view of the drum holder which supports metal rings.
Figure 8:
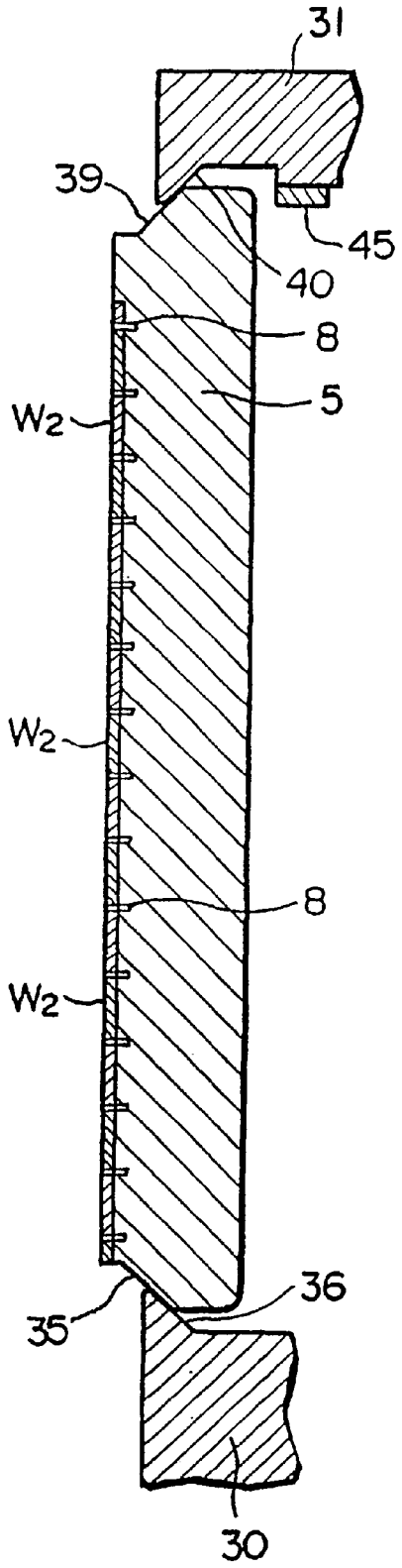
FIGS. 8(*a*) and 8(*b*) are fragmentary cross-sectional views showing the manner in which the ring remover operates.
Figure 8:
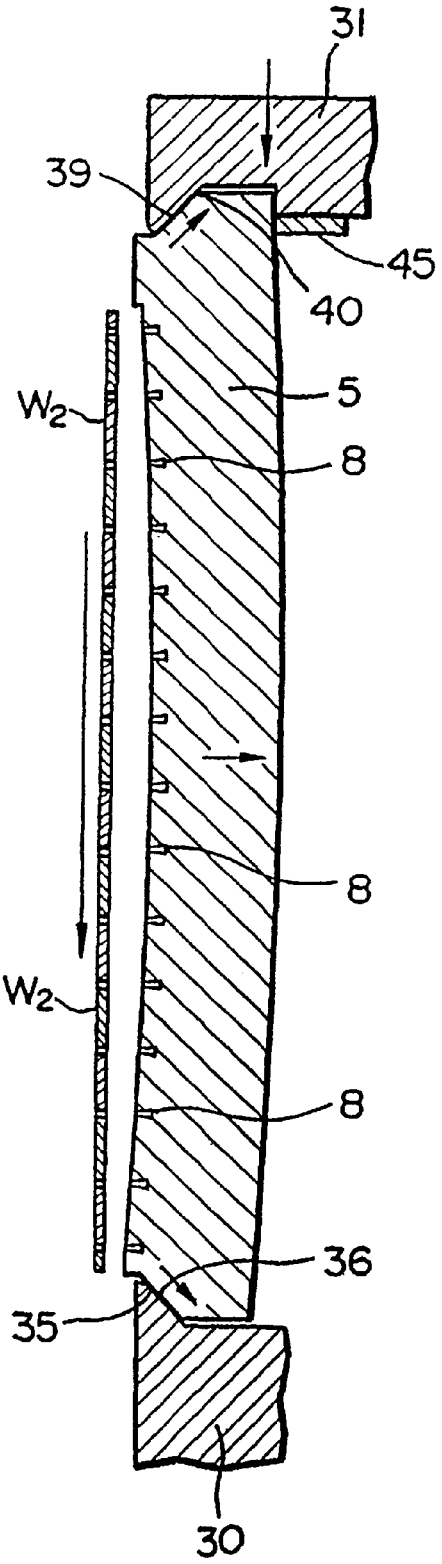

Operation of the ring remover 29 will be described below. The drum holder 5 is removed from the support shaft 4 shown in FIG. 1. Then, as shown in FIG. 7, the drum holder 5 with the sliced metal rings W2 supported on its outer circumferential surface is set, with its axis directed vertically, on the ring remover 29 shown in FIG. 6. Specifically, as shown in FIG. 6, the drum holder 5 is placed on the drum holder rest 30, and the swing lever 43 is manually lowered about the pivot shaft 42 to bring the presser 31 into abutment against the upper end of the drum holder 5. As shown in FIG. 8(*a*), the first tapered surface 35 of the drum holder 5 is held against the first slanted guide 36 of the drum holder rest 30, and the second tapered surface 39 of the drum holder 5 is held against the second slanted guide 40 of the presser 31.

Then, the swing lever 43 is further manually lowered about the pivot shaft 42. As shown in FIG. 8(*b*), the first tapered surface 35 of the drum holder 5 is slidingly guided along the first slanted guide 36 of the drum holder rest 30, and the second tapered surface 39 of the drum holder 5 is slidingly guided along the second slanted guide 40 of the presser 31. The slots 9 (see FIG. 7) in the drum holder 5 are compressed or narrowed to radially contract the drum holder 5. As shown in FIG. 8(*b*), when the drum holder 5 is axially pressed by and between the presser 31 and the drum holder rest 30, the annular grooves 8 are compressed or narrowed, causing the vertical central region of the drum holder 5 to be slightly curved radially inwardly.

The outer circumferential surface of the drum holder 5 is spaced apart from the metal rings W2, which drop by gravity off the drum holder 5. The metal rings W2 which are released from the drum holder 5 fall along the ring receiver 34 onto the base 33, as indicated by the imaginary lines in FIGS. 4–6.

In the illustrated embodiment, the ring remover 29 has the pressing means 32 for lowering the presser 31 by manually moving the swing lever 43. However, any of various other pressing means for lowering the presser 31, such as an actuating mechanism including a cylinder or a motor, be employed.

INDUSTRIAL APPLICABILITY

As described above, the drum slicing apparatus according to the present invention is capable of efficiently slicing a drum of thin metal sheet into a plurality of highly accurate metal rings. Therefore, the drum slicing apparatus can be used to manufacture metal rings for use as ring members of a belt for transmitting power in a continuously variable transmission.

What is claimed is:

1. An apparatus for slicing a cylindrical drum made of a thin metal sheet into a plurality of endless metal rings, comprising:

a support shaft rotatable about its own axis;

a cylindrical drum holder supported on said support shaft for holding said drum by pressing engagement with an inner circumferential surface of the drum over an entire length thereof; and slicing means having slicing edges for slicing the drum into the metal rings by engaging and cutting into the drum at predetermined cutting positions thereon while the drum is being rotated by said support shaft through said drum holder;

wherein said drum has recesses defined in opposite ends thereof, fully circumferential cut-off portions at said opposite ends including said recesses, and a ring forming region extending between said fully circumferential cut-off portions for forming said metal rings, said drum holder having engaging members for engaging in said recesses to prevent said fully circumferential cut-off portions from rotating when said drum holder holds said drum.

2. An apparatus according to claim 1, wherein said drum holder is removable from an end of said support shaft.

3. An apparatus according to claim 2, wherein said support shaft comprises:

a main shaft rotatable about its own axis by rotating means;

a cylindrical collet disposed over said main shaft and radially spreadable by a plurality of axial slots defined in the cylindrical collet; and spreading means for radially spreading said cylindrical collet by widening said axial slots;

said cylindrical drum holder having a plurality of axial slots defined therein which allow the cylindrical drum holder to spread radially, the arrangement being such that when said cylindrical drum holder is mounted on said cylindrical collet, said cylindrical drum holder is radially spreadable into pressing engagement with the inner circumferential surface of said drum in response to said cylindrical collet being spread by said spreading means.

4. An apparatus according to claim 3, wherein said spreading means comprises:

a tapered surface disposed on the outer circumference of a proximal end of said main shaft at an end of said collet and progressively reduced in diameter toward a distal end of said main shaft;

a tapered member movably mounted on the outer circumference of the distal end of said main shaft at an opposite end of said collet and axially movable on said main shaft, said tapered member being progressively reduced in diameter toward the proximal end of said main shaft; and a pressing member mounted on said distal end of said main shaft for engaging said tapered member, the arrangement being such that when said tapered member is pressed toward said tapered surface by said pressing member, said collet is radially spread by said tapered surface and said tapered member respective at the ends of said collet.

5. An apparatus according to claim 1, wherein said cylindrical drum is prepared by shaping a rectangular thin sheet of metal into a cylindrical form and butt-welding opposite ends of said rectangular thin sheet of metal, said recesses being used to position said opposite ends when the opposite ends are butt-welded.

6. An apparatus according to claim 1, wherein said slicing edges are spaced apart at intervals along an axial direction of said drum holder.

7. An apparatus according to claim 1, wherein said drum holder has a plurality of annular grooves defined in an outer circumferential surfaces in alignment with the respective predetermined cutting positions on said drum.

8. An apparatus according to claim 7, wherein said slicing means comprises a plurality of disk-shaped grinding wheels having abrasive grain slicing edges as said slicing edges on outer circumferential edges thereof for cutting into said predetermined cutting positions on said drum, further comprising dressing members disposed respectively in said annular grooves for dressing said abrasive grain slicing edges in sliding contact therewith when said abrasive grain slicing edges cut into said drum.

9. An apparatus according to claim 2, wherein said drum holder is radially contractible, further comprising ring removing means for radially contracting said drum holder which is removed from said support shaft while holding the metal rings sliced from said drum, thereby releasing said drum holder from pressing engagement with inner circumferential surfaces of the metal rings.

10. An apparatus according to claim 9, wherein said drum holder has a pair of tapered surfaces disposed on respective upper and lower ends thereof and progressively reduced in diameter outwardly in an axial direction thereof;

said ring removing means comprising:

radially contracting means for holding said drum holder, with its axis directed vertically, removed from said support shaft, and radially contracting said drum holder; and a ring receiver disposed below said drum holder held by said radially contracting means, for receiving the metal rings released and dropped from said drum holder when the drum holder is radially contracted;

said radially contracting means comprising:

a drum holder rest for placing said drum holder thereon in abutment against a lower end of said drum holder;

a presser vertically movably disposed in confronting relation to said drum holder rest, for pressing an upper end of said drum holder downwardly; and lifting and lowering means for lifting and lowering said presser;

said drum holder rest having a first slanted guide for slidingly engaging the tapered surface on the lower end of said drum holder to guide said drum holder in a direction to radially contract said drum holder, and said drum holder rest having a second slanted guide for slidingly engaging the tapered surface on the upper end of said drum holder to guide said drum holder in a direction to radially contract said drum holder.

11. An apparatus according to claim 1, wherein said metal rings sliced from said drum comprise ring members for bundling a plurality of elements arrayed in an endless pattern for use as a belt in a continuously variable transmission.

* * * * *